United States Patent [19]

Black

[11] 4,056,951

[45] Nov. 8, 1977

[54] PIERCED EARRING HAVING PERFUMING MEANS

[76] Inventor: Edith Black, 129 E. Beacon Road, Lakeland, Fla. 33803

[21] Appl. No.: 662,327

[22] Filed: Mar. 1, 1976

[51] Int. Cl.[2] ..... A44C 7/00

[52] U.S. Cl. ..... 63/13; 63/DIG. 2; 63/1 R

[58] Field of Search ..... 63/12, 13, DIG. 2, 29 R

[56] References Cited

U.S. PATENT DOCUMENTS

| | | | |
|---|---|---|---|
| 320,991 | 6/1885 | Westcott | 63/12 UX |
| 1,267,067 | 5/1918 | Flagg | 63/DIG. 2 |
| 1,625,375 | 4/1927 | Reyes | 63/DIG. 2 |
| 1,673,617 | 6/1928 | Clark | 63/DIG. 2 |
| 2,552,151 | 5/1951 | Cohen | 63/12 UX |
| 3,910,065 | 10/1975 | Holt | 63/DIG. 2 |

FOREIGN PATENT DOCUMENTS

| | | | |
|---|---|---|---|
| 591,935 | 4/1959 | Italy | 63/DIG. 2 |

*Primary Examiner*—F. Barry Shay

*Attorney, Agent, or Firm*—Duckworth, Hobby & Allen

[57] ABSTRACT

An earring structure for use with pierced ears includes an earring member having a post extending substantially normal from a surface of the earring member, the post adapted to extend through a pierced ear. A nut member includes means, such as threads, for joining to the extremity of the post, with one of the earring or nut members having an internal void defining a chamber adapted to hold a perfuming agent therein. Apertures extend through the one member so as to allow the perfume to communicate between the chamber and the ambient.

1 Claim, 9 Drawing Figures

PIERCED EARRING HAVING PERFUMING MEANS

BACKGROUND OF THE INVENTION

1. Field of the Invention

The present invention relates to new and useful structures for jewelry articles, and in particular relates to an earring structure useful for carrying a perfuming agent therein and allowing said agent to be dispensed in situ.

2. Description of the Prior Art

The prior art teaches a variety of jewelry structures useful for carrying a perfuming agent therein such that the agent may be dispensed while the jewelry article is being worn.

In U.S. Pat. No. 1,625,375, Reyes discloses an earring, breast pin or the like having an internal liquid-containing vial for dispensing perfume while being worn. In the structure taught by Reyes, the liquid-containing member was suspended from the earring member.

In U.S. Pat. No. 2,058,274, Vivaudou et al disclose an earring structure in which the perfuming agent is inserted from the inside of the earring member. As taught by Vivaudou et al, the perfuming agent can constitute a concentrated substance of an organic holding fat or extract with the perfuming essence absorbed therein.

In U.S. Pat. No. 2,141,402, Muller discloses a flower-shaped jewelry article in which the perfuming agent constitutes a solid insert extending through the core of the flower design. In this arrangement, the perfuming carrier constitutes a scented cartridge or filler.

In U.S. Pat. No. 2,471,949, Gilowitz discloses an aeromatic earring design, in which the earring member constitutes a hollow sphere with the perfuming agent disposed therein as a liquid. Cords extend into the liquid and through an aperture at the top of the sphere to carry the liquid perfume into the ambient. As disclosed by Gilowitz, a flower petal design may then be disposed in conjunction with the extremities of these cords.

Flagg, in U.S. Pat. No. 1,267,067, discloses a perfumed earring structure in which the holder constitutes an integral member, with the perfuming agent carried as an absorbed material in a cotton medium or the like.

Another arrangement is disclosed by Lawson et al. in U.S. Pat. No. 2,550,828. In this arrangement, the entire earring member is removable, to allow the perfuming agent to be disposed therein as an absorbed pad of perfuming material.

The arrangement disclosed by Scott in U.S. Pat. No. 2,740,662 is similar to well known locket arrangements, in which a front portion of the earring member is hinged to the back portion thereof, to allow access to an internal chamber, such that a cotton material may be inserted therein as a holding medium for the perfume.

Another structure which appears to be of peripheral interest only is disclosed in U.S. Pat. No. 3,270,525 to Sellers, which discloses a perfuming dispensing jewelry article with a frangible portion.

Other prior art patents of interest may also be found in United States Patent and Trademark Office class 63, digest 2; and certain jewelry designs of interest may be found in Design Class 45, subclass 9. Other jewelry designs of interest may also be found in other areas of classification in the United States Patent and Trademark Office.

SUMMARY OF THE INVENTION

The present invention constitutes an earring structure for use with pierced ears, comprising an earring member having a post extending from a surface of the earring member, the post adapted to extend through a pierced ear. A nut member is provided, and has means for being joined to the extremity of the post. One of the earring member and the nut member has an internal void defining a chamber which is adapted to hold a perfuming agent therein; this one of the earring and nut members has apertures communicating between the chamber and the ambient, such that the perfuming agent may be dispensed in the desired fashion. Further, this one of the earring member and the nut member having the perfuming agent therein also has means for removing a portion thereof to permit access to the chamber, such that the perfuming agent may be added as desired.

In a preferred embodiment in accordance with the present invention, the post extends substantially normal to the surface of the earring member, and the apertures only extend through that portion of the earring member or nut member which is removable from the other portion thereof.

THE DRAWINGS

DETAILED DESCRIPTION

A first embodiment of a jewelry structure in accordance with the present invention will now be described with reference to FIGS. 1 and 3.

Noting FIG. 1, this earring structure, referred to generally as 10, includes an earring member which is referred to generally as 12, the earring member having a base portion 14 and a front portion 16, is removable from the base portion 14 in a matter hereinafter described. The rear portion 14 includes a plurality of apertures 18 extending therethrough, so as to communicate with the chamber within the earring member, as is defined by the base and front members 14, 16.

Figure 3:
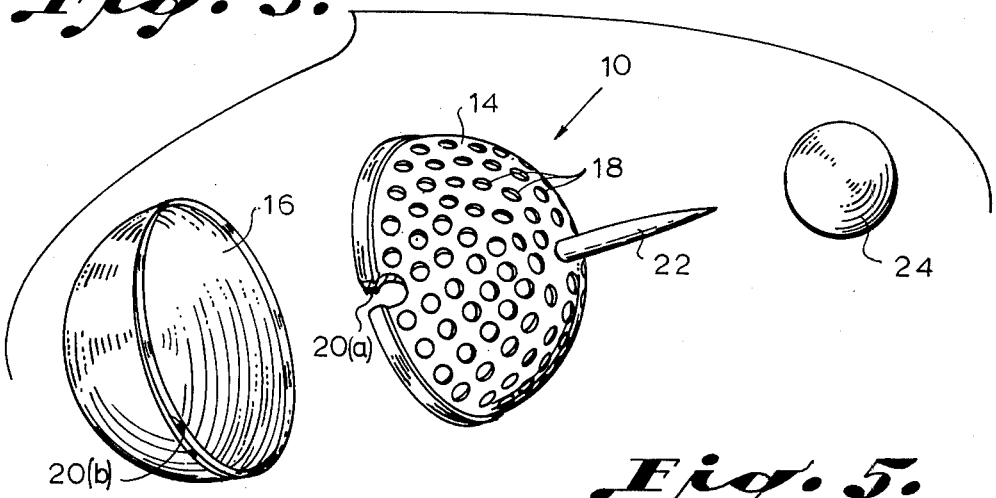
FIG. 3 is an exploded, perspective view, partially cutaway, illustrating the first embodiment of the earring structure, also shown in FIG. 1.

With specific reference to FIG. 3, the base member 14 includes inside threads **20*a* at the periphery thereof, and the front portion 16 includes outside threads 20*b* at the periphery thereof, such that the base and front portions 14, 16** may be joined together in a well known manner. It will be understood that other, equivalent fastening arrangements, such as snap-on techniques, may be utilized in place of the threaded arrangement shown in FIG. 3.

Figure 1:
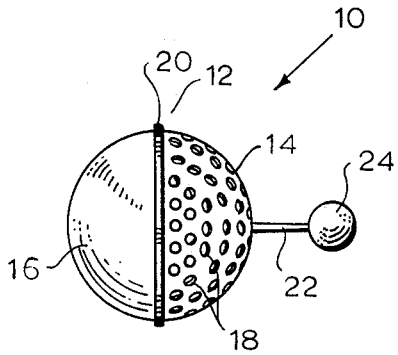
FIG. 1 is a top plan view of one embodiment of an earring structure in accordance with the present invention.

Noting both FIGS. 1 and 3, the earring 10 further includes a post 22, to which is joined a nut member 24, either by fastening on the extremity of the post or other equivalent means.

The base and front portions 14, 16 define an internal chamber within the overall earring member 12, which chamber is adapted to hold a perfuming agent, of any well known type (not shown).

Figure 2:
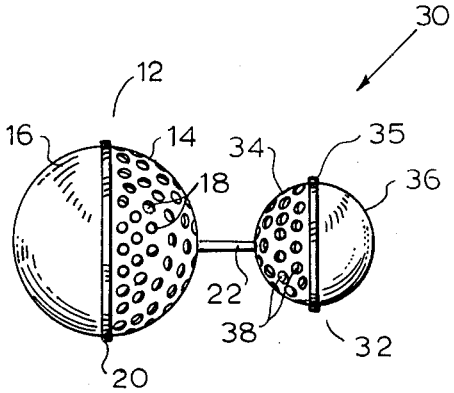
FIG. 2 is a top plan view of a second embodiment of an earring structure in accordance with the present invention.

A second embodiment of an earring structure in accordance with the present invention is shown in FIG. 2, and described with reference thereto.

The alternate embodiment of the jewelry structure, referred to generally as 30 in FIG. 2, includes an earring member 12 essentially identical to the earring member 12 in FIGS. 1 and 3; that is, the earring member 12 includes base and front portions 14, 16, apertures 18 and threads 20 which function in the manner described above with respect to FIGS. 1 and 3.

Further, the earring structure 30 of FIG. 2 includes a post 22 which extends normal to the periphery of the base portion 14 of the earring member 12 in the same manner as the post 22 in the structure 10 of FIG. 1.

The nut member 32 of the structure 30 includes a base portion 34 which is adapted to join to the extremity of the post 22 in a manner similar to the nut 24 described above with respect to the structure 10 of FIG. 1, and having an aperture 38 therein, similar to the apertures 18 in the front portion 16 of the earring member 12. Additionally, the nut member 32 of the structure 30 includes a rear portion 36. The rear portion 36 is joined to the base portion 34 of the nut member 32 by threads 35, in a manner similar to that described above. It will further be understood that the terms "front" and "rear" are used in conjunction with the earring member 12 and the nut member 32, because the front portion 16 will be oriented toward the wearer's face when the earring 30 is being worn, while the rear portion 36 will be oriented toward the back of the wearer in the same condition.

In accordance with this invention, the structure 30 of FIG. 2 allows a perfuming agent to be disposed within either the chamber defined by the earring member 12, or the chamber defined by the nut member 32, or both.

Figure 4:
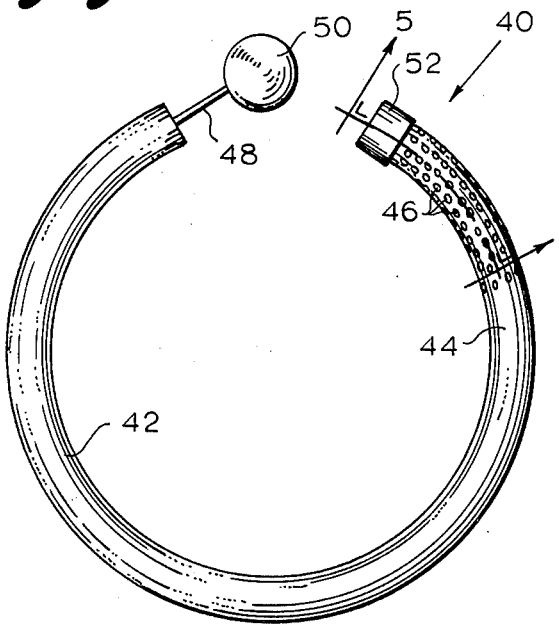
FIG. 4 is a side view of a third embodiment of an earring structure in accordance with the present invention.
Figure 5:
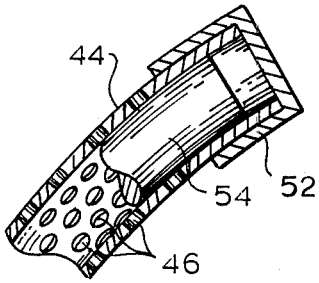
FIG. 5 is a portion of the structure shown in FIG. 4, shown in cross-section.

A third embodiment of the jewelry structure in accordance with the present invention is shown in FIGS. 4 and 5. This alternate arrangement, referred to generally as 40, includes an earring member having a front portion 42, and a rear portion 44, the rear portion being hollow (note FIG. 5) and including a plurality of apertures 46 extending therethrough. As shown in FIG. 5, a perfuming agent 54 may be inserted in the hollow rear portion 44, so as to allow the perfume to be dispensed from the chamber and to the ambient.

Further, the structure 40 includes a post 48 extending normal to the front 42, and a cap member 52 covering the rear 44. A nut member 50 is joined to the post 48 in a manner similar to that described above with reference to FIG. 1.

A fourth embodiment of an earring structure in accordance with the present invention is shown in FIGS. 6–9 and described with reference thereto.

Figure 6:
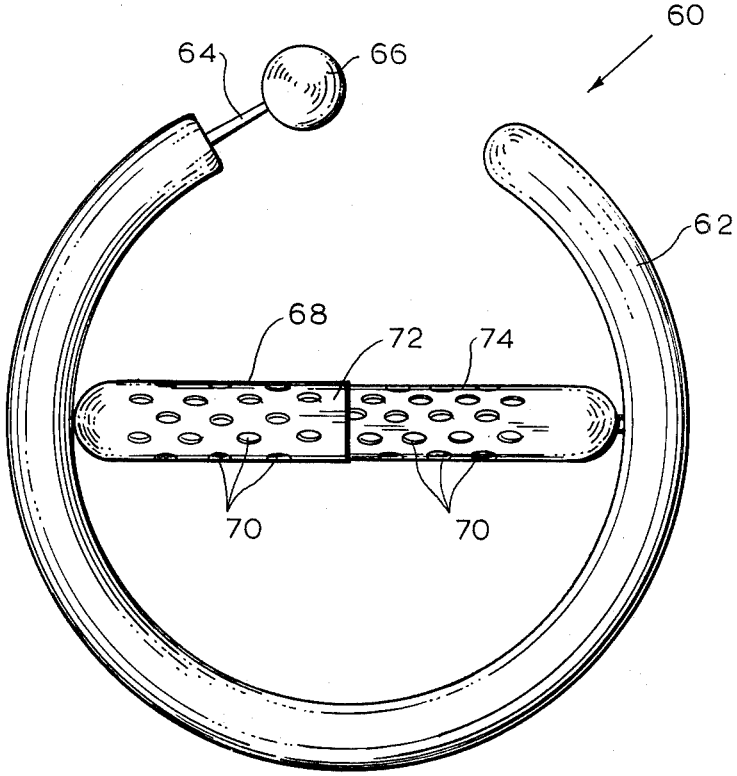
FIG. 6 is a side view of a fourth embodiment of an earring structure in accordance with the present invention.
Figure 7:
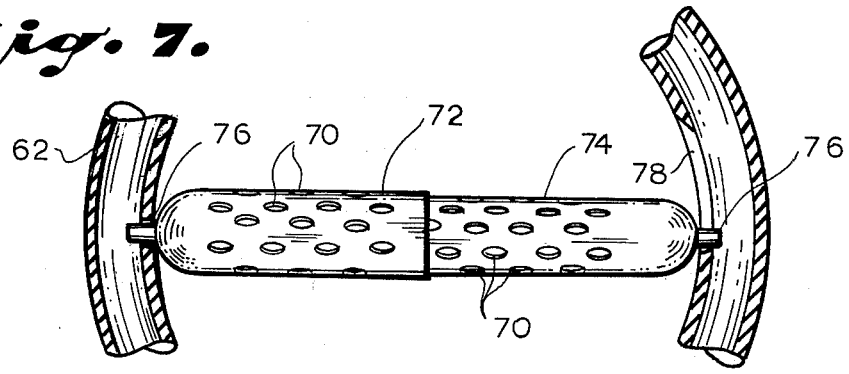
FIG. 7 is another view of the embodiment of FIG. 6, partially cut away.
Figure 8:
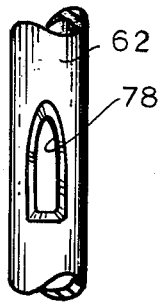
FIG. 8 is a side view of a portion of the structure of FIG. 6.
Figure 9:
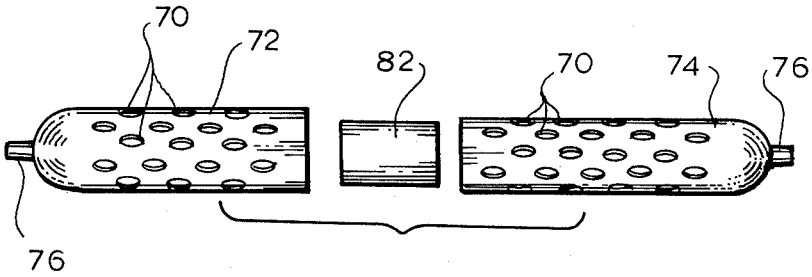
FIG. 9 is a portion of the structure of FIG. 6 shown in an exploded view.

Noting FIG. 6, the earring structure 60 includes an earring member 62 having a curved, generally circular cross-section, with a post 64 and a nut 66 associated therewith in a manner previously described above with reference to FIGS. 1–5. The earring structure 60 includes a generally cylindrical tube 68 formed of two snugly fitting sections 72 and 74, each section having apertures 70 communicating between an internal chamber of the tube 68 and the ambient. Noting FIGS. 7, 8 and 9, the cylindrical tube 68 is positioned between the inner periphery of the two sides of the curved earring member 62. This is accomplished by the use of pins 76 on opposite ends of the two portions 72, 74 of the tube 68 (note FIG. 7). One of the pins 76 extends into a hole 80 extending into the inner periphery of one side of the curved member 62, while the second pin 76 extends into a slot 78 in the inner periphery of the other side of the earring member 62 (note the shape of the slot 78 in FIG. 8). In use, the earring 60 may be provided with a solid perfuming agent 82 by removal of the cylindrical tube 68 from the slot and hole 78, 80 and sliding the tube portions 72, 74 apart to allow the perfuming agent 82 to be installed in the chamber within.

It will be appreciated by those skilled in the art that a jewelry structure in accordance with any of the embodiments of the present invention provides a useful means for dispensing a perfuming agent while the earring structure is being worn.

I claim:

1. An earring structure for use with pierced ears comprising:

an earring member comprising a curved hollow member forming a generally circular shape;

a post extending substantially normal from a surface of said earring member, said post adapted to extend through a pierced ear;

holding means for joining to the extremity of said post for holding said earring member in proximity to an ear;

means for removing a portion of said earring member; said removable portion having an internal void defining a chamber adapted to hold a perfuming agent therein; and said removable portion having apertures extending therethrough and communicating between said chamber and the ambient; wherein said removable portion comprises a generally cylindrical tube disposed between opposing sides of said curved earring member, said removing means comprising openings on the inner periphery of said opposing sides for receiving portions at the ends of said tube.

* * * * *